US006499448B2

(12) United States Patent
Yildirim et al.

(10) Patent No.: US 6,499,448 B2
(45) Date of Patent: Dec. 31, 2002

(54) APPARATUS FOR DIRECT GASOLINE INJECTION IN A PISTON ENGINE

(75) Inventors: Fevzi Yildirim, Gerlingen (DE); Michael Huebel, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/855,573

(22) Filed: May 16, 2001

(65) Prior Publication Data

US 2001/0054411 A1 Dec. 27, 2001

(30) Foreign Application Priority Data

May 17, 2000 (DE) ..... 100 24 268

(51) Int. Cl.[7] ..... F01L 9/02
(52) U.S. Cl. ..... 123/90.12; 123/502
(58) Field of Search ..... 123/90.12, 90.13, 123/502, 447, 456, 446, 321

(56) References Cited

U.S. PATENT DOCUMENTS 5,000,146 A * 3/1991 Szucsanyi ..... 123/321
5,645,030 A * 7/1997 Letsche ..... 123/321
6,321,702 B1 * 11/2001 Diehl et al. ..... 123/90.12

FOREIGN PATENT DOCUMENTS

DE 4407585 * 9/1995

* cited by examiner

*Primary Examiner*—Tony M. Argenbright
*Assistant Examiner*—Mahmoud Gimie
(74) *Attorney, Agent, or Firm*—Ronald E. Greigg

(57) ABSTRACT

An apparatus for direct gasoline injection in a piston engine, which has a hydraulic valve control system with hydraulically actuated gas exchange valves. The direct gasoline injection is associated with the hydraulic valve control system via a pressure booster for two different pressure media, which is acted upon by hydraulic oil from a high-pressure hydraulic oil reservoir of the hydraulic valve control system and which subjects a high-pressure fuel reservoir to high pressure; injection valves for direct gasoline injection in the piston engine are connected to the high-pressure fuel reservoir.

10 Claims, 3 Drawing Sheets

APPARATUS FOR DIRECT GASOLINE INJECTION IN A PISTON ENGINE

BACKGROUND OF THE INVENTION

1. Field of the Invention

The invention relates to an apparatus for direct gasoline injection in a piston engine. The apparatus is intended in particular for Otto cycle engines but it can also be employed in Diesel engines.

2. Brief Description of the Prior Art

Piston engines that have a hydraulic valve control system are known; the hydraulic valve control system replaces a widely used mechanical valve control by means of camshafts. In the hydraulic valve control system, gas exchange valves of the piston engine are actuated hydraulically. The energy required for actuation is furnished by a high-pressure hydraulic oil pump, which is typically embodied as a piston pump and which puts the hydraulic oil under high pressure and pumps it into a high-pressure hydraulic oil reservoir. The hydraulic oil, under high pressure, from the high-pressure hydraulic oil reservoir is delivered to the gas exchange valves for opening and/or closing, and the delivery is typically controlled by magnet valves, or in other words electrically. In this case, the control system is an electrohydraulic valve control system.

German Patent Disclosure DE 44 07 585 A1 proposes using fuel instead of hydraulic oil for the hydraulic valve control system. Serving as the high-pressure pump is a fuel high-pressure pump of a fuel injection system, to whose high-pressure reservoir the gas exchange valves of the piston engine are connected. This reference considers it an advantage that only one high-pressure pump is needed for both the hydraulic valve control system and for the fuel injection.

In the hydraulic actuation of gas exchange valves with fuel as the hydraulic fluid, it is considered problematic that the fuel for actuating the gas exchange valves is delivered to a cylinder head of the piston engine and is thereby heated, which is intrinsically unwanted. It also appears questionable whether fuel is a suitable hydraulic fluid. Fuel is considerably less viscous than typical hydraulic oils, so leakage problems must be feared. Fuel also lacks lubricating properties, and so if fuel is used as the hydraulic fluid, the hydraulic system is not lubricated by hydraulic fluid; on the contrary, the fuel cleans off any films of lubricant from the surfaces it acts on. The known apparatus is moreover suited only for Diesel engines, because only such engines generated sufficient fuel pressure for hydraulically opening the gas exchange valves. In Otto engines, the gasoline injection is done at low pressure, such as 4 bar of overpressure compared to atmospheric pressure. A pressure of this magnitude is in no way sufficient to actuate the gas exchange valves of a piston engine.

OBJECT AND SUMMARY OF THE INVENTION

The apparatus according to the invention for direct gasoline injection in a piston engine, in particular an Otto engine, has a pressure booster for two different pressure media. The pressure booster is acted upon by hydraulic oil, at high pressure, from the high-pressure hydraulic oil pump of a hydraulic valve control system of the piston engine. The pressure booster converts the pressure of the hydraulic oil into a higher pressure, with which it acts upon fuel. The pressure booster delivers the fuel, put under high pressure, to a high-pressure fuel reservoir, to which at least one fuel injection valve is connected.

The invention has the advantage that an existing high-pressure hydraulic oil pump of a hydraulic valve control system is used to generate a requisite high pressure for the direct fuel or gasoline injection. Thus an additional high-pressure pump for the fuel is not needed. Another advantage of the invention is that by the use of a pressure booster for two different pressure media, the fuel is separated form the hydraulic fluid for the hydraulic valve control system, and thus a hydraulic oil can be used as the hydraulic fluid. The invention additionally has the advantage that a pressure level of the hydraulic valve control system is approximately of the same order of magnitude as a pressure level in direct gasoline injection; that is, a pumping pressure of the existing high-pressure hydraulic oil pump is approximately of the same order of magnitude required for the direct gasoline injection.

The pressure level of the hydraulic valve control system is between approximately 50 and 250 bar. Modern direct gasoline injection systems have a pressure level of up to about 100 bar; pressure levels of up to 200 bar are expected, while for later development, fuel injection pressures of up to about 400 bar are expected. Since the pressure booster readily makes a pressure boost of up to 1:5 possible, the pressure levels for the direct gasoline injection are readily attainable. If the pressure level of the hydraulic valve control system is sufficient for the direct gasoline injection, the pressure booster can even have a boosting ratio of 1:1 and in that case is a pressure medium converter, which has the task of keeping the fuel separate from the hydraulic oil and acting on it with the pressure of the hydraulic oil. If a lower pressure level than for the hydraulic valve control system is sufficient for the direct gasoline injection, then the pressure booster can even have a boosting ratio of less than 1.

The aforementioned pressure levels for the hydraulic valve control system and the direct gasoline injection should be understood to mean high pressure, in the context of the invention. Pressure levels of conventional (intake-tube) gasoline injection systems, for instance of about 4 bar, should be understood as low pressure.

Another advantage of the invention is that it needs only one pressure booster, even for multi-piston internal combustion engines that have more than one injection valve.

BRIEF DESCRIPTION OF THE DRAWINGS

The invention will be better understood and further objects and advantages thereof will become more apparent from the ensuing detailed description taken in conjunction with the drawings, in which.

DESCRIPTION OF THE PREFERRED EMBODIMENTS

Figure 1:
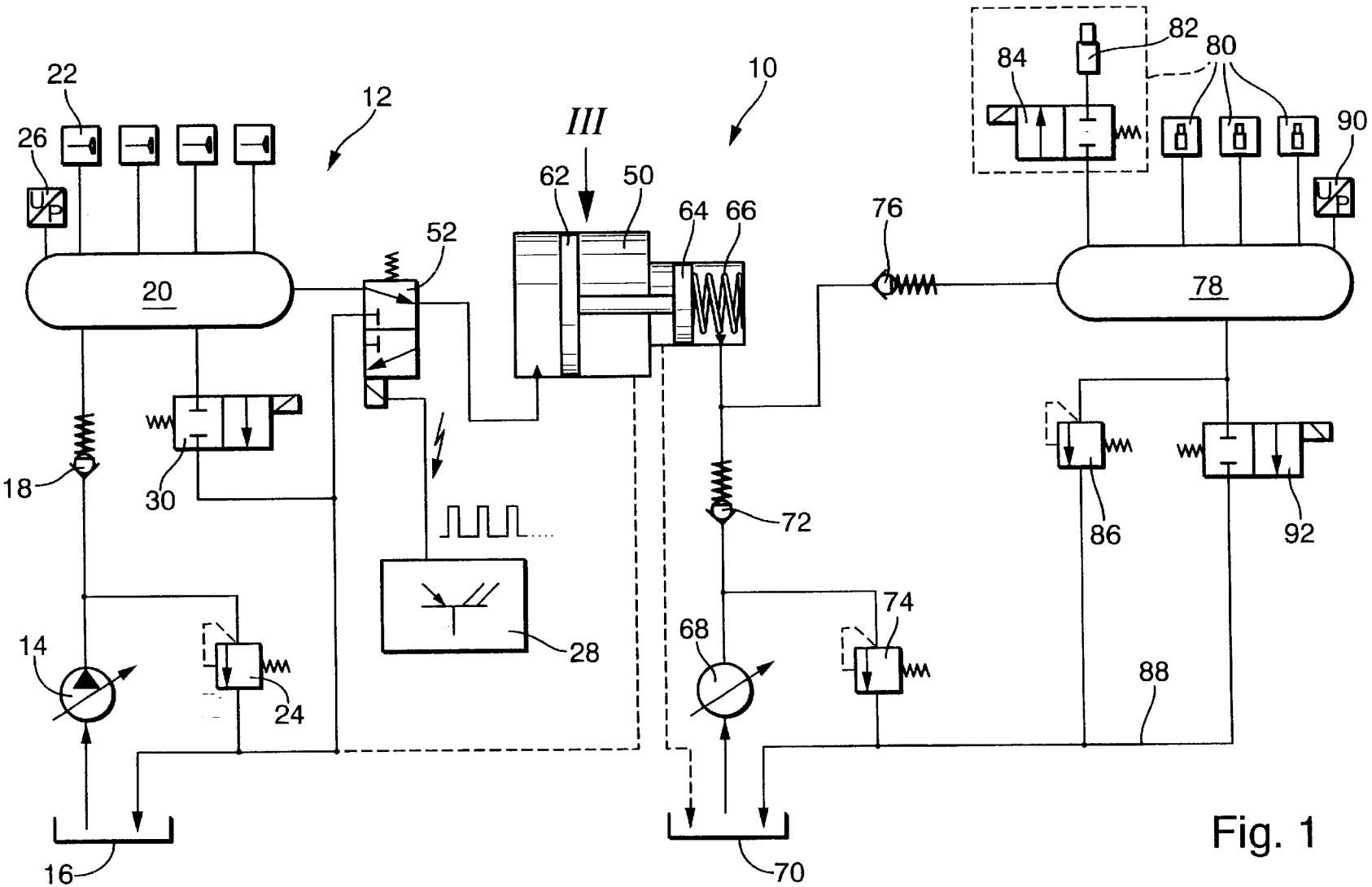
FIG. 1 is a circuit diagram of an apparatus according to the invention for direct gasoline injection with electrohydraulic valve control.

The apparatus for direct gasoline injection shown in FIG. 1 and identified overall by reference numeral 10 is intended for a piston engine, not shown, in particular an Otto engine. The piston engine utilizing the invention has an electrohydraulic valve control system 12. The electrohydraulic valve control system 12 has a high-pressure hydraulic oil pump 14, which aspirates hydraulic oil from an oil supply container 16. Connected to the compression side of the high-pressure hydraulic oil pump 14, with the interposition of a check valve 18, is a high-pressure hydraulic oil reservoir 20, to which in turn a number of hydraulically actuatable gas exchange valves 22 of the piston engine are connected, of which one is shown schematically in FIG. 2.

Connected to the compression side of the high-pressure hydraulic oil pump 14 is a pressure limiting valve 24, which limits a pumping pressure of the high-pressure hydraulic oil pump 14 and thus a pressure in the high-pressure hydraulic oil reservoir 20 to a maximum value, for instance of about 250 bar. Hydraulic oil emerging through the pressure limiting valve 24 flows back into the oil supply container 16.

A pressure sensor 26 is connected to the high-pressure hydraulic oil reservoir 20 and its signal is supplied to an electronic control unit 28 for monitoring the pressure in the high-pressure hydraulic oil reservoir 20. A pressure medium converter 30 is also connected to the high-pressure hydraulic oil reservoir 20; in the exemplary embodiment shown it is embodied as a 2/2-way magnet valve and controlled by the electronic control unit. By means of the pressure medium converter 30, a pressure prevailing in the high-pressure hydraulic oil reservoir 20 can be reduced, so that a desired pressure below the maximum pressure can be established in the high-pressure hydraulic oil reservoir 20. The pressure prevailing in the high-pressure hydraulic oil reservoir 20 can be varied by means of the pressure medium converter 30 and as a result can be set as a function of the operating state of the piston engine.

Figure 2:
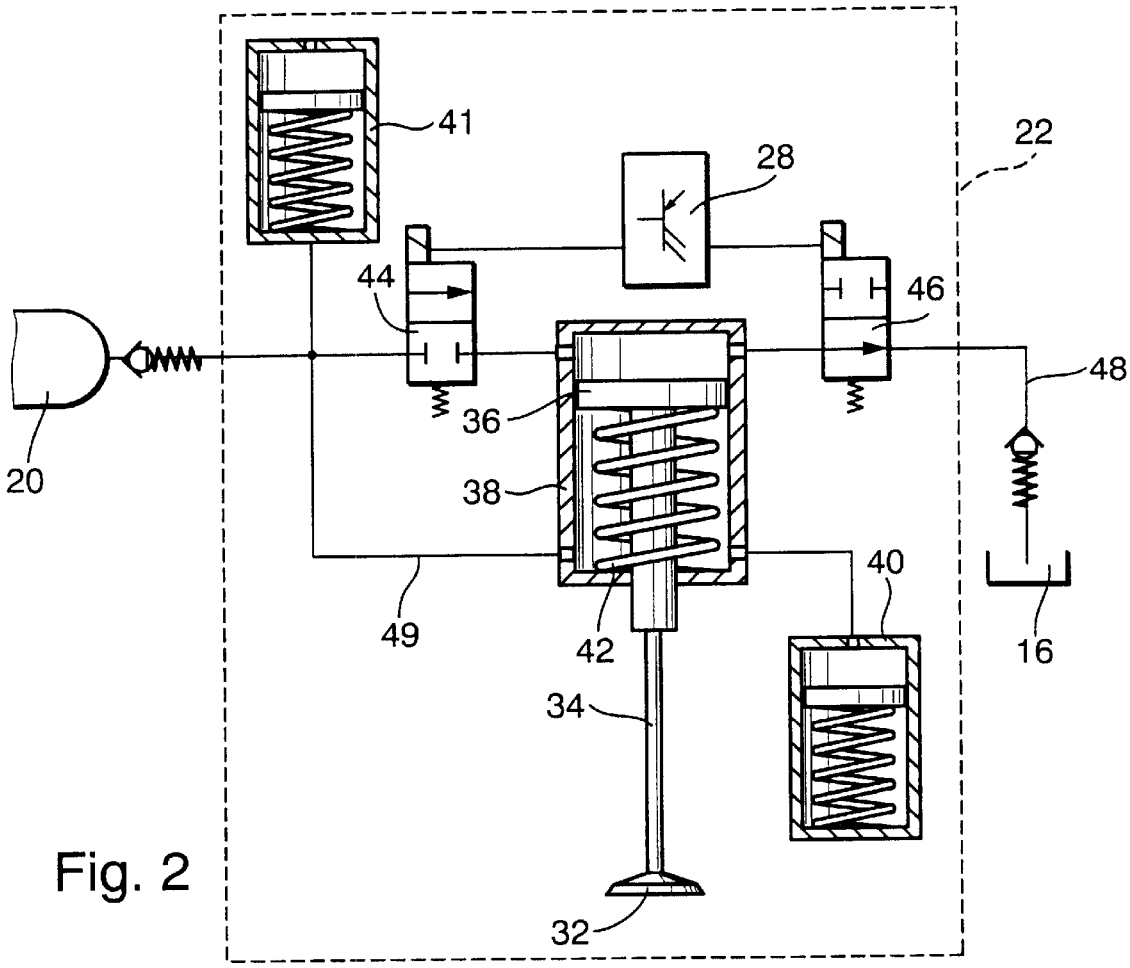
FIG. 2 is a circuit diagram of a hydraulically actuatable gas exchange valve.

The gas exchange valve 22 shown in FIG. 2 as a circuit diagram has a valve plate 32 and a stepped valve stem 34, integral with the valve plate 32, of the kind known from known gas exchange valves that are mechanically driven via a camshaft. The valve stem 34 has a piston 36, which is received axially displaceably in a cylinder 38. By subjection of the cylinder 38 to hydraulic oil, at high pressure, from the high-pressure hydraulic oil reservoir 20, the gas exchange valve 22 is opened. To close the gas exchange valve 22, its piston 36 is embodied as bidirectional; its back side is subjected to hydraulic oil from a spring-impinged pressure reservoir 40 that is connected on the back side of the piston 36 to the cylinder 38. For restoration of its position on an emergency basis, the gas exchange valve 22 has an emergency spring 42, which if there is a pressure loss in the pressure reservoir 40 restores the piston 36 of the gas exchange valve 22 to an outset position, in which the gas exchange valve 22 is closed.

For actuation, the gas exchange valve 22 has two valves 44, 46, which are embodied as 2/2-way valves 44, 46. The two magnet valves 44, 46 are controlled by the electronic control unit 28. The first of the two magnet valves, 44, is disposed between the high-pressure hydraulic oil reservoir 20 and the cylinder 38 of the gas exchange valve 22. The second magnet valve, 46, is open in its basic position; from it, an oil line 48 leads back to the oil supply container. For opening the gas exchange valve 22, the first magnet valve 44 is opened and the second magnet valve 46 is closed, and as a result the cylinder 38 of the gas exchange valve 22 is acted upon by hydraulic oil, at high pressure, from the high-pressure hydraulic oil reservoir 20. The hydraulic oil displaces the piston 36 and as a result opens the gas exchange valve 22. Upon this displacement, the back side of the bidirectional piston 36 positively displaces hydraulic oil out of the cylinder 38 into the pressure reservoir 40. For closing the gas exchange valve 22, its first magnet valve 44 is closed and the cylinder 38 of the gas exchange valve 22 is thereby disconnected from the high-pressure hydraulic oil reservoir 20. At the same time, the second magnet valve 46 is opened and as a result the cylinder 38 communicates with the oil supply container 16. The hydraulic oil under pressure from the pressure reservoir 40 forces the piston 36 back into its outset position, in which the gas exchange valve 22 is closed. In the process, hydraulic oil is positively displaced out of the cylinder 38 into the oil supply container 16.

The gas exchange valve 22 has a further pressure reservoir 41, which is connected to the high-pressure hydraulic oil reservoir 20 between the first magnet valve 44 and the high-pressure reservoir 20. From this pressure reservoir 41, a hydraulic line 49 on the back side of the piston 36 leads to the cylinder 38. Since the area of the piston acted upon on its front side is larger, because of the valve stem 34 on the back side of the piston 36, than on its back side, the gas exchange valve 22 opens, when the valve 44 is open, even if there is equal pressure on both sides of the piston.

In addition to the gas exchange valves 22, a pressure booster 50 for two different pressure media, namely the hydraulic oil on the one hand and fuel on the other, is connected to the high-pressure hydraulic oil reservoir 20. Connected between the pressure booster 50 and the high-pressure hydraulic oil reservoir 20 is a 3/2-way magnet valve 52, which is controlled by the electronic control unit 38. In a currentless basic position the magnet valve 52 makes the pressure booster 50 communicate with the high-pressure hydraulic oil reservoir 20; in a switching position with current applied, the magnet valve makes the pressure booster 50 communicate with the oil supply container 16.

The pressure booster 50 has one large and one small piston 62, 64, which are rigidly joined to one another and are rigidly displaceable in a housing of the pressure booster 50. The large piston 62 is acted upon, when the magnet valve 52 is in its basic position, by hydraulic oil from the high-pressure hydraulic oil reservoir 20.

Figure 3:
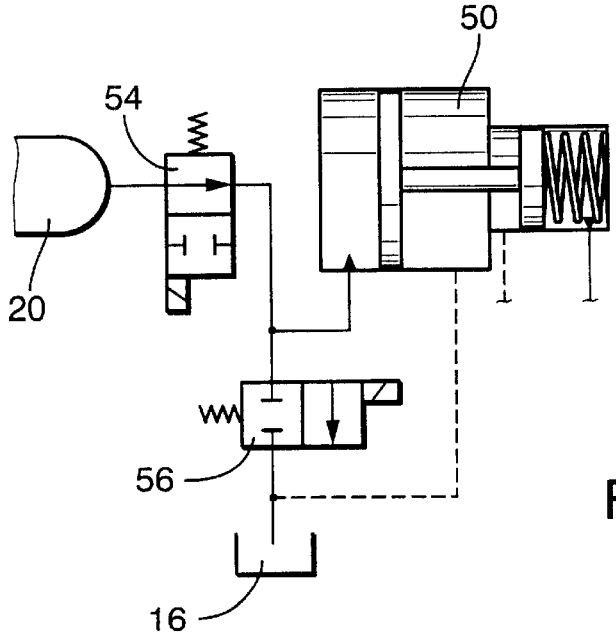
FIGS. 3–6 show a detail indicated by the arrow III in FIG. 1 for modified embodiments of the invention.

The 3/2-way magnet valve 52 can be replaced in a manner known per se by two 2/2-way magnet valves 54, 56, as shown in FIG. 3.

Figure 4:
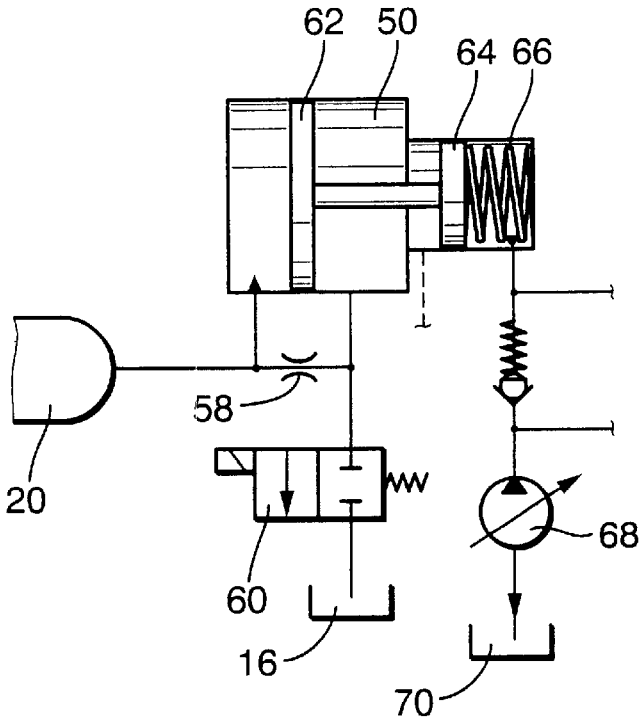

One possible way of replacing the 3/2-way magnet valve 52 of FIG. 1 with a single, less expensive 2/2-way magnet valve 52 is shown in FIG. 4. Here an oil line leads, without the interposition of a valve, directly from the high-pressure hydraulic oil reservoir 20 to the pressure booster 50; the hydraulic oil from the high-pressure hydraulic oil reservoir 20 acts directly on the larger piston 62 of the pressure booster 50. Via a throttle restriction 58, a back side of the larger piston 62 of the pressure booster 50 is likewise acted upon by hydraulic oil from the high-pressure hydraulic oil reservoir 20, so that the same pressure prevails on both sides of the larger piston 62 of the pressure booster 50. To displace both pistons 62, 64 of the pressure booster 50, the pressure on the back side of the larger piston 62 is reduced by opening a 2/2-way magnet valve 60. For restoring the two pistons 62, 64, the 2/2-way magnet valve 60 is closed again, so that the fuel pumped by the fuel pump 68 and acting upon the smaller piston 64 of the pressure booster 50 restores the two pistons 62, 64. The two pistons 62, 64 are also restored by the piston restoring spring 66 of the pressure booster 50.

Figure 5:
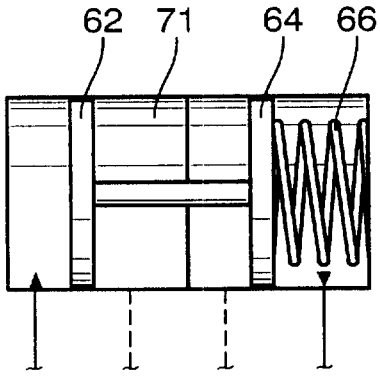
Figure 6:
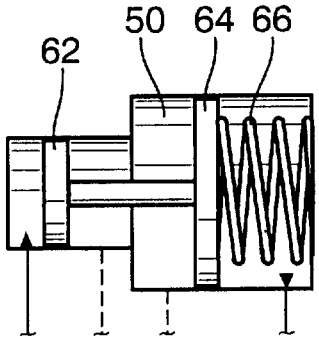

The apparatus 10 according to the invention for direct gasoline injection has a low-pressure fuel pump 68, with which fuel from a fuel tank 70 on the side toward the small piston 64 can be pumped to the pressure booster 50. Between the fuel pump 68 and the pressure booster 50, there is a check valve 72 that allows a flow in the direction of the pressure booster 50. A pressure limiting valve 74 is connected to a compression side of the fuel pump 68, and from this valve a fuel line leads back to the fuel tank 70. The function of the pressure booster 50 is as follows: When the magnet valve 52 is in its basic position, the large piston 62 is acted upon by hydraulic oil from the high-pressure hydraulic oil reservoir 20. As a result, the two pistons 62, 64 of the pressure booster 50 are displaced, and the small piston 64 positively displaces fuel, pumped into the pressure booster 50 by the fuel pump 68, into a high-pressure fuel reservoir 78 that is connected to the pressure booster 50 with the interposition of a check valve 76. In the process the pressure booster 50 raises a pressure of the fuel to a value that is at the same ratio to the pressure of the hydraulic oil as the surface areas of the large and small piston 62, 64 are to one another. If no pressure boost is needed, the two pistons 62, 64 of the pressure booster 50 can have areas of equal size, as shown in FIG. 5. In that case, the pressure booster 50 is a pressure medium converter 71. It is also possible in principle for fuel to act on the larger piston 64 of the pressure booster 50 and for hydraulic oil to act on a smaller piston 62; as a result, the pressure of the fuel is correspondingly less than the pressure of the hydraulic oil. This is shown in FIG. 6.

After the displacement of the pistons 62, 64 of the pressure booster 50, the magnet valve 52 is switched over to the switching position, and as a result the pressure booster 50 communicates with the oil supply container 16. The fuel pump 68 pumps fuel to the pressure booster 50, which positively displaces the smaller piston 64, and the smaller piston 64 is displaced back into its outset position. The smaller piston 64 displaces the larger piston 62, which is rigidly joined to it, back into its outset position as well, and the larger piston 62 positively displaces hydraulic oil out of the pressure booster 50 into the oil supply container 16. By continuous switchover of the magnet valve 52 from the basis position to the switching position and back again, the pistons 62, 64 of the pressure booster 50 are displaced back and forth in alternation; the fuel is thereby put at high pressure as described and is positively displaced into the high-pressure fuel reservoir 78. For switching the magnet valve 52 back and forth, it is acted upon by a square pulse voltage, for example. The frequency of the pulse voltage can be varied and the fuel pumping capacity of the pressure booster 50 can thus be adapted to the needs of the piston engine.

To restore the pistons 62, 64 of the pressure booster 50, the pressure booster can also have a piston restoring spring 66.

For each cylinder of the piston engine, one injection valve 80 is connected to the high-pressure fuel reservoir 78. The injection valves 80 have an injection nozzle 82 and, for controlling the fuel injection, a 2/2-way magnet valve 84, which is typically combined with the injection nozzle 82 to make a structural unit known as an injection valve 80.

To guard against bursting, a pressure limiting valve 86 is connected to the high-pressure fuel reservoir 78, and from this valve a return line 88 leads to the fuel tank 70. For monitoring the pressure in the high-pressure fuel reservoir 78, a pressure sensor 90 is connected to it and furnishes a signal to the electronic control unit 28. By means of the electronic control unit 28, via the magnet valve 52, a pumping capacity of the pressure booster 50 can be controlled such that a desired pressure prevails in the high-pressure fuel reservoir 78, and this pressure can also be adapted to various operating conditions during operation of the piston engine. To reduce the pressure of the fuel in the high-pressure fuel reservoir 78, a pressure medium converter 92 is connected to this high-pressure reservoir; the pressure medium converter 92 is embodied as a 2/2-way magnet valve and is likewise connected to the return line 88 to the fuel tank.

In the high-pressure fuel reservoir 78, a pressure of about 100 bar to about 200 bar, for example, prevails. Higher pressures of about 400 to 500 bar are feasible without any problem.

The foregoing relates to a preferred exemplary embodiment of the invention, it being understood that other variants and embodiments thereof are possible within the spirit and scope of the invention, the latter being defined by the appended claims.

We claim:

1. An apparatus for direct gasoline injection in a piston engine, the piston engine having a hydraulic valve control system with a high-pressure hydraulic oil pump, a high-pressure hydraulic oil reservoir connected to the high-pressure hydraulic oil pump, and hydraulically actuatable gas exchange valves, the apparatus (10) comprising a pressure booster (50) for two different pressure media, the pressure booster being connected to the hydraulic oil reservoir to be acted upon by hydraulic oil from the high-pressure hydraulic oil reservoir (20) of the hydraulic valve control system (12), a high-pressure fuel reservoir (78) connected to said pressure booster (50); and at least one fuel injection valve (80) connected to the high-pressure fuel reservoir (78).

2. The apparatus of claim 1, further comprising a valve (52, 54) connected between the high-pressure hydraulic oil reservoir (20) and the pressure booster (50) said valve (52, 54) in one valve position connecting the pressure booster (50) with the high-pressure hydraulic oil reservoir (20) and in another valve position disconnecting the pressure booster (50) from the high-pressure hydraulic oil reservoir (20).

3. The apparatus of claim 2, further comprising means for switching said valve (52, 54) continuously back and forth between the two valve positions.

4. The apparatus of claim 1, wherein said pressure booster (50) comprises a pressure medium converter (71).

5. The apparatus of claim 1, wherein said apparatus (10) further comprises a fuel feed pump (68) operably connected to said pressure booster (50) for pumping fuel to the pressure booster.

6. The apparatus of claim 5, further comprising a check valve (72) connected between said fuel feed pump (68) and said pressure booster (50), said check valve (72) being operable to allow a flow in the direction of the pressure booster (50).

7. The apparatus of claim 6, further comprising a pressure limiting valve (74) connected downstream of the fuel feed pump (68).

8. The apparatus of claim 1, further comprising a check valve (76) connected between the pressure booster (50) and the high-pressure fuel reservoir (78), said check valve being operable to allow a flow in the direction of the high-pressure fuel reservoir (78).

9. The apparatus of claim 1, further comprising a pressure limiting valve (86) operably connected with said high-pressure fuel reservoir (78) to limit the pressure them.

10. The apparatus of claim 1, further comprising a pressure medium converter (92) and a pressure sensor (90) operably connected with said high-pressure fuel reservoir (78).

* * * * *